United States Patent [19]

Fortenberry

[11] 4,447,951

[45] May 15, 1984

[54] FOLDING KNIFE STRUCTURE

[76] Inventor: Charles K. Fortenberry, 3112 Vandenberg, Wichita, Kans. 67210

[21] Appl. No.: 365,240

[22] Filed: Apr. 5, 1982

[51] Int. Cl.[3] ..... B26B 1/04

[52] U.S. Cl. ..... 30/161

[58] Field of Search ..... 30/155, 159, 160, 161, 30/156, 157, 158

[56] References Cited

U.S. PATENT DOCUMENTS

| | | | |
|---|---|---|---|
| 199,966 | 2/1878 | Elmer | 30/161 |
| 1,087,342 | 2/1914 | Yerzley | 30/157 |
| 1,234,345 | 7/1917 | Keeran | 30/158 |
| 2,304,601 | 12/1942 | Schrade | 30/159 |
| 4,312,128 | 1/1982 | Olsen | 30/157 |

FOREIGN PATENT DOCUMENTS

| | | | |
|---|---|---|---|
| 385840 | 12/1923 | Fed. Rep. of Germany | 30/161 |

*Primary Examiner*—Jimmy C. Peters
*Attorney, Agent, or Firm*—Phillip A. Rein

[57] ABSTRACT

The folding knife structure of this invention is operable to present a blade member which is rigidly held so as to not be movable in any direction except upon great pressure to the folded condition. Our folding knife structure includes a handle assembly; a spring bias assembly connected to the handle assembly; and, a blade assembly pivotally connected to the handle assembly and operably connected to the spring bias assembly. The spring bias assembly includes a spring member having a main body connected to the handle assembly and, integral therewith, a guide portion which is engageable with the blade assembly. The blade assembly includes a blade member having a blade body; an alignment portion integral with the main blade body; and, a cutting edge integral with the main blade body. This invention lies in the contacting relationship of the guide portion of the spring member and the alignment or lock portion of the blade member so as to achieve a line contact therebetween. This line contact operates to rigidly hold the blade member in its opened position and automatically takes up for wear between the contacting surfaces.

7 Claims, 7 Drawing Figures

FOLDING KNIFE STRUCTURE

PRIOR ART

The applicant herein does not know of any United States or foreign patent references as a patentability investigation was not deemed necessary. However, the applicant herein is a skilled craftsman having made many hunting knives and other knife structures mainly for custom buyers. The invention herein is directed particularly to the area of folding knife structures, and, more particularly, to the problem of having a knife blade, when in the open condition, held rigidly by a knife handle assembly and a spring bias assembly. That is the particular problem area to which the invention herein is directed.

PREFERRED EMBODIMENT OF THE INVENTION

In one preferred embodiment of the invention, a folding knife structure is provided having a blade member held by a handle assembly when the open position is a rigid condition without undesireable movement thereof. The folding knife structure consists of (1) a handle assembly; (2) a spring bias assembly mounted in the handle assembly; and, (3) a blade assembly which is pivotally mounted to the handle assembly and held in the opened and closed positions by the spring bias assembly. The handle assembly includes a pair of opposed handle grip members interconnected by a connector means. The handle grip members can be of various design having a contour which is readily grasped in a person's hand for the safe usage thereof. Each handle grip member consists of a inner support plate having an outer, normally wood or bone main body member secured thereto. The connector means consists of a plurality of rivet-type members, namely four, which interconnects both the handle assembly and the spring bias assembly. The spring bias assembly consists of a spring member which acts both as a spacer between the handle grip members and also as a leaf spring-type so as to bias the blade assembly in both the opened and closed positions. The spring member consists of a main body having a guide portion thereon. The main body is of a contour so as to receive the blade assembly within the confines of the handle assembly when in the closed position. The main body consists of an anchor portion integral with the guide portion whereupon the guide portion is flexible when the blade assembly is moved from the opened to the closed position. A couple embodiments of the guide portions are noted herein being mainly formed with a substantially V-shaped notched area adjacent to the connection of the blade assembly. The blade assembly includes a blade member having a (1) main body portion; (2) an alignment portion; and, (3) a cutting edge portion. The main body portion can be of various shapes which generally resembles a conventional knife structure having at an inner end thereof a connector portion. The connector portion is secured as by one of the rivet members between the handle grip members and being within lateral alignment of the spring member. The cutting edge portion is provided with a sharp edge as in a conventional knife structure extended from the connector portion outwardly to an end tip portion. The alignment portion is adjacent the connector portion of the main body member and consists of a generally V-shaped upper edge which is adapted to fit within the guide portion of the spring member in a opened position. It is noted that the alignment portion is provided with a two-point contact with the guide portion of the spring member which exerts considerable pressure on both sides thereof to hold the blade member in a rigid condition when in the opened position, which is the primary objective of this invention.

OBJECTS OF THE INVENTION

One object of this invention is to provide a folding knife structure having a knife blade member which is rigidly held in the opened position against any lateral movement thereof.

Another object of this invention is to provide a folding knife structure having guide and alignment means thereof to hold the knife blade in a rigid condition when in the opened position.

Still, one further object of this invention is to provide a folding knife structure having a knife blade member which is easily moved to the opened position and held in a non-movement position with a minimum amount of expense.

Still, another object of this invention is to provide a folding knife structure having a blade member held in a rigid condition in both the opened and closed positions which is simple to use, economical to manufacture, and substantially maintenance free.

Various other objects, advantages and features of the invention will become apparent to those skilled in the art from the following description, taken in conjunction with the accompanying drawings, in which:

FIGURES OF THE INVENTION

Figure 1:
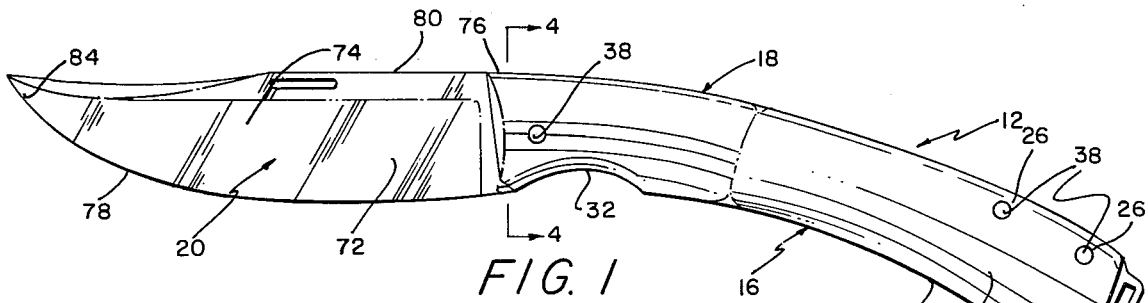
FIG. 1 is a side elevation view of a folding knife structure of this invention as shown in the opened position.

The following is a discussion and description of preferred specific embodiments of the folding knife structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, a folding knife structure of this invention, indicated generally 12 is shown in FIG. 1 in the opened position. The folding knife structure 12 includes (1) a handle assembly 16; (2) a spring bias assembly 18; and, (3) a blade assembly 20 pivotally connected to the handle assembly 16 and operably engageable with the spring bias assembly 18.

The handle assembly 16 includes a pair of opposed handle grip members 22, 24 interconnected by a connector means 26. The handle grip members 22, 24 are substantially identical but being reversed in outer contour for obvious reasons.

Each handle grip member 22, 24 includes an inner support plate 28 having a main body member 30 connected thereto. Each inner support plate 28 conforms to the inner contour of each main body member 30 as usually of a thin metal plate construction.

Each main body member 30 is normally constructed of a wood or bone material and having a first contour portion 32 adapted to receive a person's forefinger and an integral secondary contour portion 34 adapted to receive the remaining fingers on a person's hand. It is also obvious that each inner support plate 28 of each handle grip member 22, 24 is contoured as indicated at 36 in order to be comfortably grasped by a person's hand during usage of the folding knife structure 12.

The connector means 26 consists of a plurality of elements such as bolts or screw members or, as shown here, there are four (4) rivet members 38 used herein. Three (3) of the rivet members 38 are adjacent an outer end portion 40 to provide rigidity between the handle assembly 16 and the spring bias assembly 18 as will be explained.

The spring bias assembly 18 includes a main spring member 42 normally constructed of a tempered spring steel material. The spring member 42 includes a main body 44 having an integral guide portion 46 therewith. The main body 44 includes an arcuate portion 48 integral with a connector portion 50 which, in turn, connects to the guide portion 46. The connector portion 50 is formed with three (3) holes 52 therein, each adapted to receive one of the rivet members 38 therein. The arcuate portion 48 and the connector portion 50 cooperate to form a curved surface 54 which is adapted to receive the blade assembly 20 therein.

Figure 2:
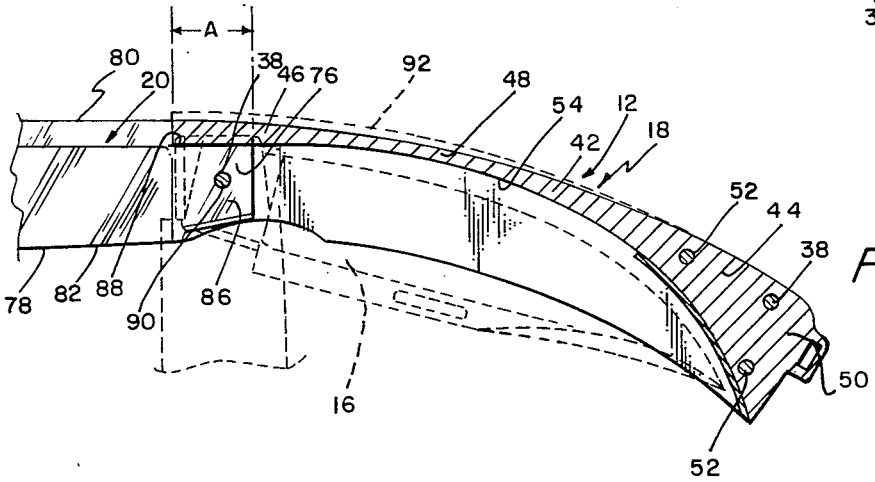
FIG. 2 is a fragmentary side sectional view showing the folding knife structure of this invention with a blade member illustrated as moving to the closed position in dotted lines.
Figure 3:
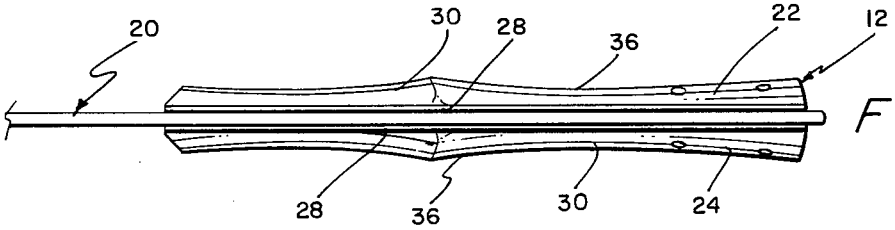
FIG. 3 is a fragmentary bottom view of the folding knife structure of this invention.
Figure 4:
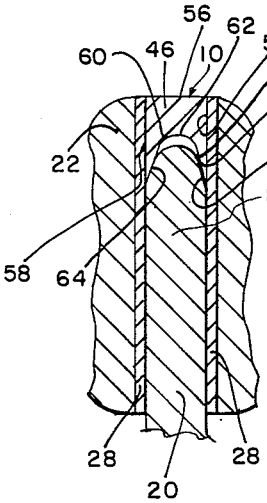
FIG. 4 is an enlarged sectional view taken along line 4—4 in FIG. 1.

The guide portion 46 of the spring member 42 extends a distance as indicated by the letter "A" in FIG. 2. As shown in FIG. 4, one embodiment of the guide portion 46 includes a top wall 56 with opposed parallel side walls 58 having an arcuate section 60 therebetween. In this embodiment, the arcuate section 60 is of a generally curved shape having a center portion indicated at 62 with integral side wall portions 64.

Figure 5:
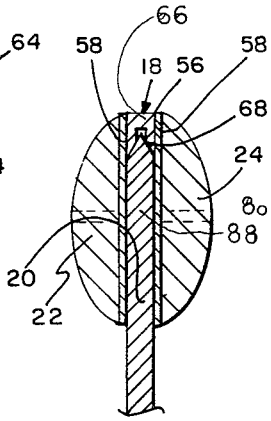
FIG. 5 is a view similar to FIG. 4 of a second embodiment of a folding knife structure of this invention.
Figure 6:
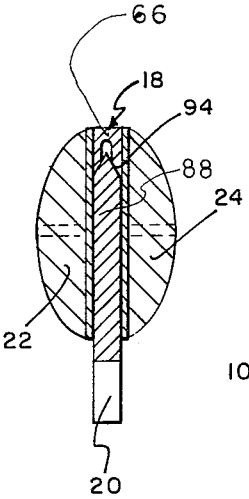
FIG. 6 is a view similar to FIG. 5 of the second embodiment of the folding knife structure of this invention showing a blade member in a different folded position; and, FIG. 7 is an enlarged view of the second embodiment of the folding knife structure of this invention shown as moving from the opened and closed position.
Figure 7:
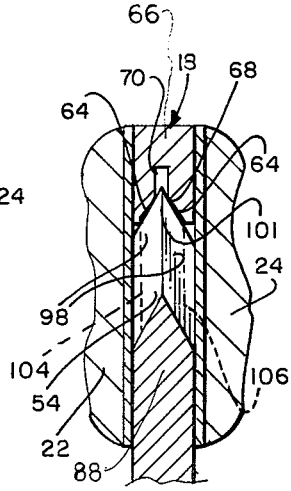

A second embodiment is shown in FIGS. 5, 6 and 7 of a guide portion 66 which consists of the top wall 56 and side walls 58 but having a different arcuate section 68 therebetween. More particularly, the arcuate section 68 includes a rectangular slot portion 70 integral with outer sidewall portions 64. The importance of the slot portion 70 and the sidewalls portions 64 will be fully explained when describing the use and operation of this invention.

As noted in FIGS. 1 and 2, the blade assembly 20 consists of a blade member 72 which is of a generally conventional nature except for the special locking feature of this invention which will be noted herein. The blade member 72 includes (1) a main blade body 74; (2) an alignment portion 76 integral with the main blade body 74; and, (3) a cutting edge portion 78 which is integral with one side of the main blade body 74.

The main blade body 74 is of a substantially conventional nature having a top wall 80 which is tapered downwardly and inwardly to the cutting edge portion 78 as found on conventional knives. The cutting edge portion 78 includes a sharp edge indicated at 82 leading from adjacent the handle assembly 16 extended outwardly into an outer pointed tip portion 84.

The alignment portion 76 consists of a main body section 86 integral at an outer edge with a lock portion 88. The main body section 86 is provided with a hole 90 therein to receive one of the rivet members 38 therein and provides for a pivot point for rotation of the blade assembly 20 thereabout.

As shown in one embodiment of the invention in FIG. 4, the lock portion 88 can be formed of a curved surface 92 which is engagable on a two-point line contact with the guide portion 46 of the spring member 42 as will be explained.

A second embodiment of the invention as shown in FIGS. 5, 6 and 7, includes a lock portion 94 constructed of a V-shaped portion 96 having inclined sidewalls 98 which are of a different pitch than that of the guide portion 46 of the spring member 42 for reasons to become obvious.

USE AND OPERATION OF INVENTION

The folding knife structure 12 of this invention is shown in the folded condition in FIG. 2 and the fully extended condition in FIG. 1. The folding knife structure 12 resembles a conventional folding or pocket knife structure wherein the blade member 72 can be opened and closed as desired.

In order to open the folding knife structure 12 to the position of FIG. 2, it is noted that the blade member 72 is pivoted in a clockwise direction about the supporting rivet member 38 towards the opened position. On pivotal movement of the blade member 72 to the initial 90 degree position relative to the handle assembly 16, it is seen that contact between the body portion 88 moves the upper guide portion 46 of the spring member 42 as shown by a dotted line indicated at 99.

On movement from the position of 90 degrees relative to the handle assembly 16 as indicated in FIG. 2, it is seen that the lock portion 88 or 94 on the blade member 72 is moving into the guide portion 46 in the spring member 42.

On further movement to the fully extended usage position, it is seen that the lock portion 88 or 94 moves into a two-point line contact with the guide portion 46 on the spring member 42. This line contact continues axially at both the lock portions 88 or 94 and the guide portion 46 so that pressure is maintained thereupon by the spring member 42 to hold the blade member 72 rigidly relative to the handle assembly 16.

In the second embodiment as shown in FIGS. 5, 6 and 7, it is seen that the upper edge indicated at 101 of the V-shaped portion 96 is adapted to be fit within the slot portion 70 of the guide portion 66. Also, the various slopes of the guide portion indicated at 46 and 66 and that of the lock portions indicated at 88 and 94 are of a different angular relationship so as to assure only longitudinal line contact between these two surfaces indicated at 104 and 106. This line point contact is very important as it provides the desired pressure upon the blade member 72 to maintain the same rigidly held against vertical and lateral movement. Also, the line contact is very important here in that the lines merely move their positions on wear between the contacting surfaces and will not cause the blade member 72 to become loose therein.

The old system of holding a blade assembly within a handle assembly by the use of a spring bias assembly was where the spring member and the lock portion on conventional folding knife structures were flat surfaces which allowed the blade member to move laterally.

It is seen that the folding knife structure of this invention is simple to manufacture, easy to use, and substantially maintenance free. The folding knife structure of this invention overcomes a common problem in normal folding knife structures whereupon the blade members therein can be moved in a limited manner in all directions.

While the invention has been described in conjunction with preferred specific embodiments thereof, it will be understood that this description is intended to illustrate and not to limit the scope of this invention, which is defined by the following claims.

I claim:

1. A folding knife structure, comprising:

(a) a handle assembly;

(b) a spring bias assembly connected to said handle assembly having a guide portion;

(c) a blade assembly including a blade member pivotally connected to said handle assembly having a lock portion selectively engagable with said guide portion; and, (d) said guide portion and said lock portion having opposed points of contact as seen in transverse cross-section when said blade assembly is in an opened position.

2. A folding knife structure as described in claim 1, wherein:

(a) said guide portion of arcuate shape operable to engage opposed sides of said lock portion.

3. A folding knife structure as described in claim 1, wherein:

(a) said lock portion of arcuate shape operable to engage opposite sides of said guide portion.

4. A folding knife structure as described in claim 1, wherein:

(a) said guide portion having a outer slot portion integral with outwardly divergent sidewalls; and, (b) said sidewalls engagable in opposed line contact with said lock portion.

5. A folding knife structure as described in claim 4, wherein:

(a) said lock portion of curved shape to engage said sidewalls of said guide portions in opposed point line contact.

6. A folding knife structure as described in claim 4, wherein:

(a) said lock portion of triangular shape in transverse cross-sections.

7. A folding knife structure as described in claim 4, wherein:

(a) said lock portion having a pointed outer edge which inserts into said outer slot portion when said blade member is in the opened position.

* * * * *